US011813727B2

(12) United States Patent
Liaw

(10) Patent No.: US 11,813,727 B2
(45) Date of Patent: Nov. 14, 2023

(54) CUSHION DEVICE OF PNEUMATIC TOOL

(71) Applicant: REA LEE INDUSTRIAL CO., LTD., Dali (TW)

(72) Inventor: Jian-Shiou Liaw, Dali (TW)

(73) Assignee: REA LEE INDUSTRIAL CO., LTD., Dali (TW)

( * ) Notice: Subject to any disclaimer, the term of this patent is extended or adjusted under 35 U.S.C. 154(b) by 127 days.

(21) Appl. No.: 17/400,293

(22) Filed: Aug. 12, 2021

(65) Prior Publication Data

US 2023/0053300 A1 Feb. 16, 2023

(51) Int. Cl.
*B25D 9/02* (2006.01)
*B25D 17/24* (2006.01)

(52) U.S. Cl.
CPC ..... *B25D 17/24* (2013.01); *B25D 9/02* (2013.01); *B25D 2217/0073* (2013.01)

(58) Field of Classification Search
CPC ..... B25D 17/24; B25D 9/02
See application file for complete search history.

(56) References Cited

U.S. PATENT DOCUMENTS 2,035,643 A * 3/1936 Douglass ..... B25D 17/043 173/137
2,058,583 A * 10/1936 Forss ..... B25D 17/043 173/137
3,712,179 A * 1/1973 Hanson ..... F01B 11/04 91/290
5,533,579 A * 7/1996 Chu ..... B25D 17/245 173/13
2012/0312155 A1* 12/2012 Beaulieu ..... F15B 15/223 91/418

FOREIGN PATENT DOCUMENTS

TW 485879 U 5/2002
TW M427242 U 4/2012

* cited by examiner

*Primary Examiner* — Praachi M Pathak

(57) ABSTRACT

A cushion device of a pneumatic tool has a body, a cushion, and a piston assembly. The body includes a containing portion which has a bottom surface. The cushion is mounted in the containing portion of the body, is formed cylindrical, and has an axial direction, two end surfaces, an interior, an exterior, and at least one passage. The two end surfaces are separately located along the axial direction, and one of the two end surfaces abuts against the bottom surface of the containing portion. The at least one passage is disposed on the cushion, and communicates with the interior and the exterior. The piston assembly is movably mounted to the containing portion of the body and has a base and a cylinder. The base has an abutting portion abutting against the other one of the two end surfaces of the cushion. The cylinder is connected with the base.

6 Claims, 4 Drawing Sheets

CUSHION DEVICE OF PNEUMATIC TOOL

BACKGROUND OF THE INVENTION

1. Field of the Invention

The present invention relates to a pneumatic tool, and more particularly to a cushion device of a pneumatic hammer.

2. Description of Related Art

With reference to Taiwan utility model patents No. 485879 and No. M427242, a cushion device of a conventional pneumatic hammer comprises a body, a piston assembly, a cushion, and a spiral compression spring. The piston assembly is mounted to a cavity of the body. The cushion and the spiral compression spring are mounted between a bottom surface of the cavity and the piston assembly, so as to absorb a backlash from the piston assembly. The cushion is a solid cylinder, and the compression spring is sheathed on the cushion.

However, the cushion device of the conventional pneumatic hammer has the following shortcomings.

1. The structure of the spiral compression spring leads to low elastic modulus, so the spiral compression spring is easily deformed and buckled. Malfunction occurs due to buckling of the compression spring.

2. When the cushion is compressed by the piston assembly in use, the cushion often sticks to the bottom surface of the cavity because of vacuum or quasi-vacuum between the cushion and the bottom surface of the cavity. This situation obstructs fluent motions of the piston assembly, and in due course, the conventional pneumatic hammer cannot normally operate.

SUMMARY OF THE INVENTION

The main objective of the present invention is to provide a cushion device of a pneumatic tool that can solve the above-mentioned problems of the cushion device of the conventional pneumatic hammer.

The cushion device of a pneumatic tool has a body, a cushion, and a piston assembly. The body includes a containing portion which has a bottom surface. The cushion is mounted in the containing portion of the body, is formed cylindrical, and has an axial direction, two end surfaces, an interior, an exterior, and at least one passage. The two end surfaces are separately located along the axial direction of the cushion, and one of the two end surfaces abuts against the bottom surface of the containing portion. The at least one passage is disposed on the cushion, and communicates with the interior and the exterior. The piston assembly is movably mounted to the containing portion of the body and has a base and a cylinder. The base has an abutting portion abutting against the other one of the two end surfaces of the cushion. The cylinder is connected with the base.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
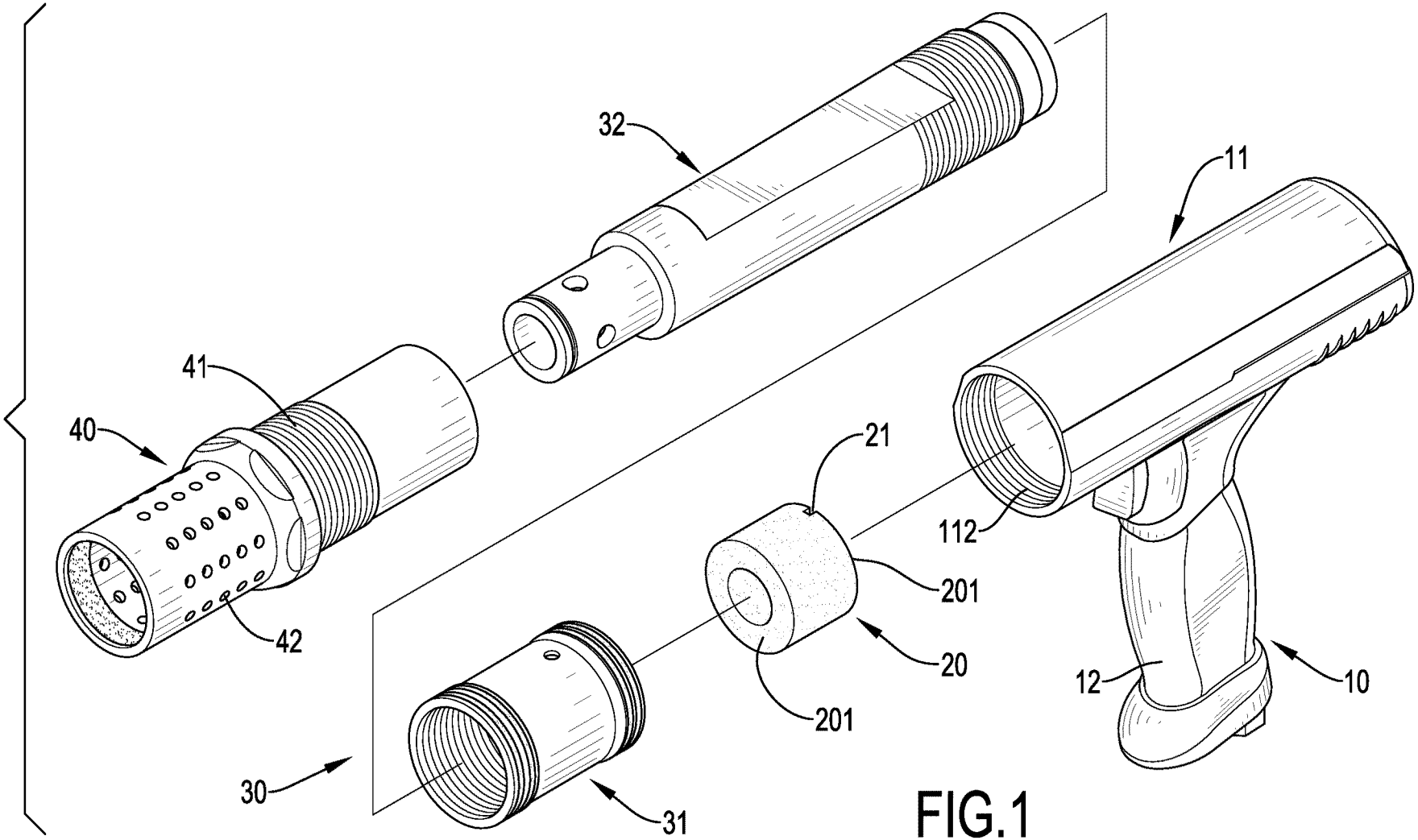
FIG. 1 is an exploded perspective view of a first embodiment of a cushion device of a pneumatic tool in accordance with the present invention.
Figure 2:
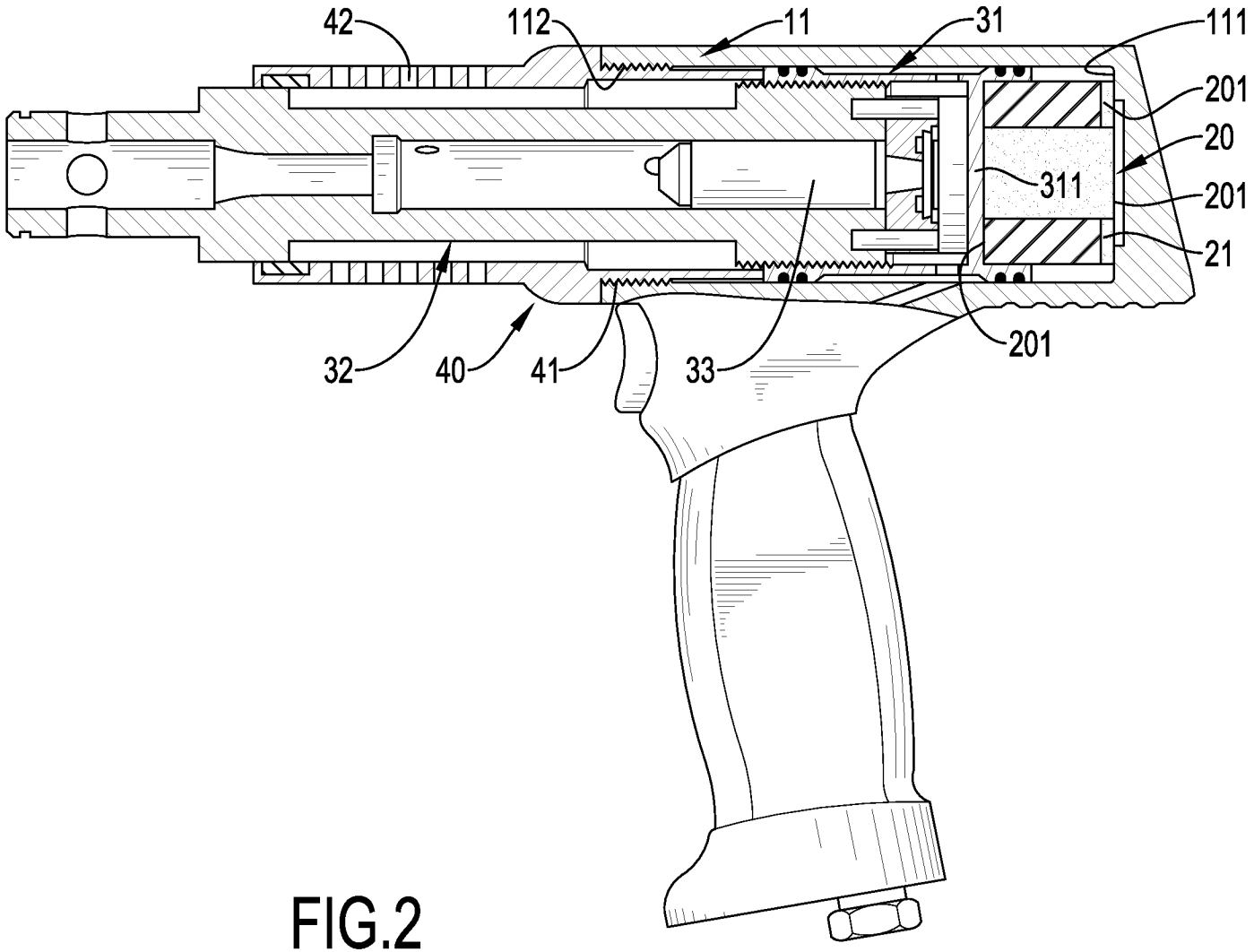
FIG. 2 is a side view in partial section of the cushion device in FIG. 1.
Figure 3:
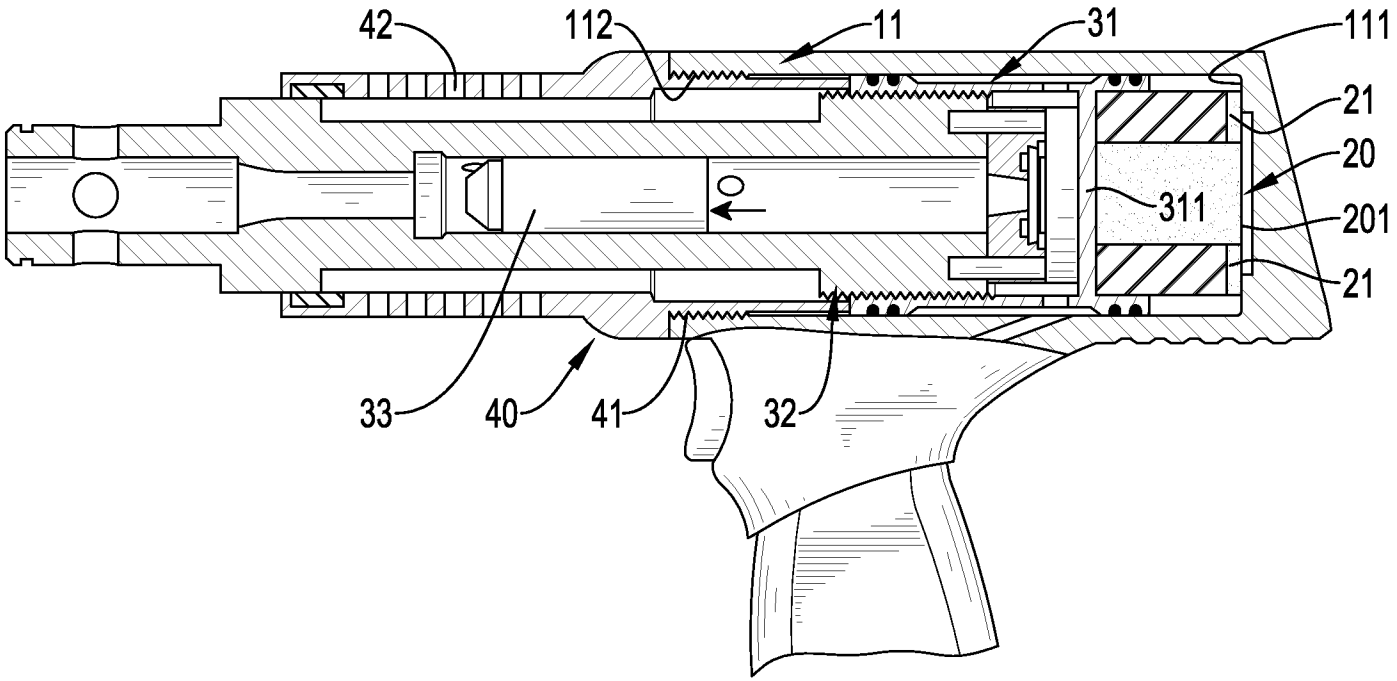
FIG. 3 is an operational side view in partial section of the cushion device in FIG. 1.

With reference to FIGS. 1 to 3, a first embodiment of a cushion device of a pneumatic tool in accordance with the present invention comprises a body 10, a cushion 20, a piston assembly 30, and an exhaust pipe 40.

With reference to FIGS. 1 and 2, the body 10 has a containing portion 11 and a handle 12. The containing portion 11 has a cavity including an open end and a closed end. The containing portion 11 has a bottom surface 111 formed on the closed end of the cavity and an inner thread 112 formed on the open end of the cavity. The handle 12 protrudes downwardly from a middle part of the containing portion 11.

The cushion 20 is made of rubber, is formed cylindrical, and has an axial direction, two end surfaces 201, and at least one passage 21. The two end surfaces 201 are separately located along the axial direction of the cushion 20, and with reference to FIG. 2, one of the two end surfaces 201 abuts against the bottom surface 111 of the containing portion 11. An interior and an exterior are defined by the cylindrical configuration of the cushion 20. The at least one passage 21 is disposed on the cushion 20, and communicates with the interior and the exterior defined by the cylindrical configuration of the cushion 20.

In the first preferred embodiment, with reference to FIGS. 2 and 3, the cushion has two said passages 21. Each of the two passages 21 is a groove disposed on the end surface 201 which abuts against the bottom surface 111 of the containing portion 11. Besides, the two passages 21 are diametrically opposed to each other. As a consequence, through either passage 21, air may flow from the interior to the exterior of the cushion 20, and vice versa.

Figure 4:
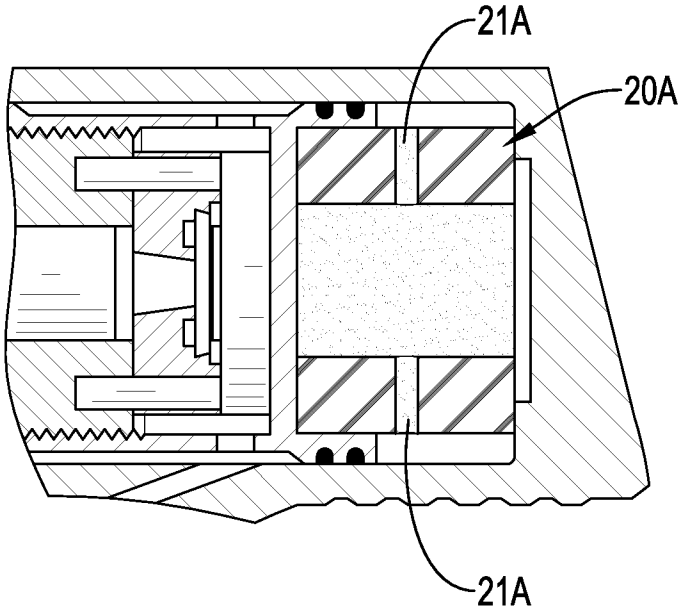
FIG. 4 is an enlarged cross-sectional side view of a second embodiment of a cushion device of a pneumatic tool in accordance with the present invention.

Furthermore, with reference to FIG. 4, for a second embodiment of a cushion device of a pneumatic tool of the present invention, the cushion 20A has two said passages 21A, and each passage 21A is a through hole disposed through a sidewall of the cushion 20A. The two passages 21A are diametrically opposed, and the interior and the exterior of the cushion 20A communicate with each other via the two passages 21A.

With reference to FIGS. 2 and 3, in the first embodiment of the present invention, the piston assembly 30 is movably mounted to the containing portion 11 of the body 10, and has a base 31, a cylinder 32, and a piston 33. One of two sides (a rear side) of the base 31 forms an abutting portion 311. The abutting portion 311 abuts against the other end surface 201 of the cushion 20 which is different from the end surface 201 abutting against the bottom surface 111. The cylinder 32 extends into the base 31 from the other one of the two sides (a front side) of the base 31, and is mounted with the base 31 by threads. The piston 33 is movably mounted in the cylinder 32, and moves back and forth along the axial direction of the of the cushion 20 so as to apply impact.

With reference to FIGS. 1 to 3, the exhaust pipe 40 is sheathed on the cylinder 32. A rear segment of the exhaust pipe 40 abuts against the front side of the base 31. The exhaust pipe 40 has an outer thread 41 and multiple holes 42.

The outer thread 41 is mounted with the inner thread 111 of the containing portion 11 of the body 10, so the exhaust pipe 40 is connected to the containing portion 11. The multiple holes 42 are disposed through a front segment of the exhaust pipe 40 at spaced intervals for air to escape.

With the aforementioned technical features, the cushion device of a pneumatic tool of the present invention has the following advantages.

1. The cushion 20, 20A has an elastic modulus larger than that of the spiral compression spring of the conventional pneumatic hammer due to the cylindrical configuration and the material of the cushion 20, 20A. Thus, the cushion 20, 20A cannot be easily buckled when compressed by the base 31 of the piston assembly 30 and the bottom surface 111.

2. Moreover, an air pressure difference between the interior and the exterior of the cushion 20, 20A is balanced via the at least one passage 21, 21A. Therefore, the sticking problem of the cushion device caused by vacuum or quasi-vacuum can be prevented. That is to say, if a pneumatic tool adopts the cushion device in accordance with the present invention, the pneumatic tool works fluently consistently.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cushion device of a pneumatic tool comprising:
- a body including a containing portion which has a bottom surface;
- a cushion mounted in the containing portion of the body, formed cylindrical, and having
  - an axial direction;
  - two end surfaces separately located along the axial direction of the cushion, and one of the two end surfaces abutting, against the bottom surface of the containing portion;
  - an interior;
  - an exterior; and
  - at least one passage disposed on the cushion, communicating with the interior and the exterior of the cushion, and being a groove disposed on one of the two end surfaces of the cushion; and
- a piston assembly movably mounted to the containing portion of the body and having
  - a base having an abutting portion abutting against the other one of the two end surfaces of the cushion; and
  - a cylinder connected with the base.

2. The cushion device as claimed in claim 1, wherein the cushion is made of rubber.

3. The cushion device as claimed in claim 2, wherein the piston assembly comprises a piston mounted in the cylinder, and the base is sheathed on are end of the cylinder.

4. The cushion device as claimed in claim 3, wherein the cushion device has an exhaust pipe sheathed on the cylinder and connected to the containing portion of the body.

5. A cushion device of a pneumatic-tool comprising:
- a body including a containing portion which has a bottom surface;
- a cushion mounted in the containing portion of the body, formed cylindrical, and having
  - an axial direction;
  - two end surfaces separately located along the axial direction of the cushion, and one of the two end surfaces abutting against the bottom surface of the containing portion;
  - an interior;
  - an exterior; and
  - at least one passage disposed on the cushion, and communicating with the interior and the exterior of the cushion; and
- a piston assembly movably mounted to the containing portion of the body and having
  - a base having an abutting portion abutting against the other one of the two end surfaces of the cushion; and
  - a cylinder connected with the base;

wherein the cushion is made of rubber, and the piston assembly comprises a piston mounted in the cylinder, and the base is sheathed on an end of the cylinder; and wherein the cushion device has an exhaust pipe sheathed on the cylinder and connected to the containing portion of the body.

6. A cushion device of a pneumatic tool comprising:
- a body including a containing portion which has a bottom surface;
- a cushion mounted in the containing portion of the body, formed cylindrical, and having
  - an axial direction;
  - two end surfaces separately located along the axial direction of the cushion, and one of the two end surfaces abutting against the bottom surface of the containing portion;
  - an interior;
  - an exterior; and
  - at least one passage disposed on the cushion, and communicating with the interior and the exterior of the cushion; and
- a piston assembly movably mounted to the containing portion of the body and having
  - a base having an abutting portion abutting against the other one of the two end surfaces of the cushion; and a cylinder connected with the base;

wherein the at least one passage is a through hole disposed through a sidewall of the cushion;

the cushion is made of rubber;

the piston assembly comprises a piston mounted in the cylinder, and the base is sheathed on an end of the cylinder; and the cushion device has an exhaust pipe sheathed on the cylinder and connected to the containing portion of the body.

* * * * *